US012005332B2

(12) United States Patent
Bean

(10) Patent No.: US 12,005,332 B2
(45) Date of Patent: Jun. 11, 2024

(54) GOLF FRAME TRAINER

(71) Applicant: Richard Joseph Bean, Southbury, CT (US)

(72) Inventor: Richard Joseph Bean, Southbury, CT (US)

( * ) Notice: Subject to any disclaimer, the term of this patent is extended or adjusted under 35 U.S.C. 154(b) by 0 days.

(21) Appl. No.: 15/914,861

(22) Filed: Mar. 7, 2018

(65) Prior Publication Data

US 2019/0275398 A1 Sep. 12, 2019

(51) Int. Cl.
*A63B 69/36* (2006.01)
*A63B 69/00* (2006.01)

(52) U.S. Cl.
CPC ..... *A63B 69/0059* (2013.01)

(58) Field of Classification Search
CPC ..... A63B 69/3608; A63B 69/0059
USPC ..... 473/276
See application file for complete search history.

(56) References Cited

U.S. PATENT DOCUMENTS 3,419,276 A * 12/1968 Poggioli ..... A63B 69/3608 116/67 R
4,245,841 A * 1/1981 Owens, Jr. ..... A63B 69/0059 473/212
5,048,837 A * 9/1991 Manley ..... A63B 69/0059 473/214
5,076,587 A * 12/1991 Manley ..... A63B 69/0059 473/214
5,472,206 A * 12/1995 Manley ..... A63B 69/0059 128/881
5,501,464 A * 3/1996 Dalbo ..... A63B 69/0059 473/215
5,743,805 A * 4/1998 Richter ..... A63B 69/0059 473/213
7,510,480 B2 * 3/2009 Lesko ..... A63B 69/0059 473/212
7,775,898 B1 * 8/2010 Allen ..... A63B 69/0059 473/207
2003/0148814 A1 * 8/2003 Kim ..... A63B 69/0059 473/227
2005/0161911 A1 * 7/2005 Piva ..... A63C 10/04 280/623
2007/0093310 A1 * 4/2007 Moscovici ..... A63B 69/3608 473/212
2009/0176592 A1 * 7/2009 Sery ..... A63B 69/3608 473/213

* cited by examiner

*Primary Examiner* — Raeann Gorden
(74) *Attorney, Agent, or Firm* — Ware, Fressola, Maguire & Barber LLP

(57) ABSTRACT

A golf training apparatus to be worn on the arm of a player, for improving the player's swing by supporting his one (target directed) arm and thereby avoiding the tendency for inadvertent bending thereof during his swing. An elongate support member is clamped in position on the arm, and an adjustable loop on the apparatus is tighten-able by the player's free hand, to hold the elbow against bending. The advantage is improved accuracy of the club head, and minimization of undesirable slices or hooks. One hand operation is facilitated, to install or remove the accessory.

18 Claims, 3 Drawing Sheets

GOLF FRAME TRAINER

NO CROSS REFERENCES TO RELATED APPLICATIONS

Field of the Invention

Background of the Invention and Sampling of Related Art

The present invention relates generally to the game of golf and accessories for the play thereof, and more particularly to training aids for improving a golfer's swing.

The following references are believed to be pertinent to the technological field to which the present invention pertains.

U.S. Pat. Nos.:

| | | |
|---|---|---|
| 3,900,199 | Aug. 19, 1975 | McGonagle |
| 802,623 | October 1905 | Camp |
| 2,468,580 | April 1949 | Weis et al. |
| 3,423,095 | January 1969 | Cox |
| 3,658,345 | April 1972 | Siggson |

One of the most significant and common golf swing flaws, is losing the frame in the golf swing. Losing the frame is a compound error. The frame is maintained by keeping the arms connected to the body, keeping the target side arm straight, keeping the trail arm bent, with the trail elbow close to the rib-cage, until impact.

There have been devices as previously cited that were designed to try and keep the forward arm straight, by the way of a plank along the bottom (elbow side) of the arm and straps on the ends that tighten. They are time consuming and awkward to put on and take off and they don't address variations in the point of hyper-extension for different golfers' anatomies. There were attempts to make a solid sleeve type device, which have many issues. The arm can still bend, and the device is very uncomfortable, and cumbersome to put on and take off.

Reduction in the tendency to bend the prominent arm acts to improve the angle that the club face makes with the ball, and in addition tends to avoid unavoidable rotations of the ball that result in the phenomena known as a hook or a slice.

SUMMARY OF THE INVENTION

The invention provides a device comprising a main support beam, arm braces, a quick adjusting buckle, a strap, an elbow support, and hardware to assemble the various parts.

The invention further provides, for golf, a training apparatus to be worn on the arm of a player, said apparatus comprising in combination an elongate, substantially rigid support member, a plurality of arm braces affixed to the elongate support member, one of said arm braces having an open mouth, means connected with another of said arm braces providing an open mouth to fit at least partially around the player's arm, and an adjustable tensioning device connected with said other arm brace, for enabling the player to adjust the force thereof on his arm, so as to permit him to tighten the device when installing it, or to loosen the device when removing it.

Other features and advantages will hereinafter appear.

BRIEF DESCRIPTION OF THE DRAWINGS

In the accompanying drawings illustrating a preferred embodiment of the invention.

DESCRIPTION OF THE PREFERRED EMBODIMENT, AND BEST MODE FOR CARRYING OUT THE INVENTION AS OF THE INSTANT FILING DATE

Figure 3:
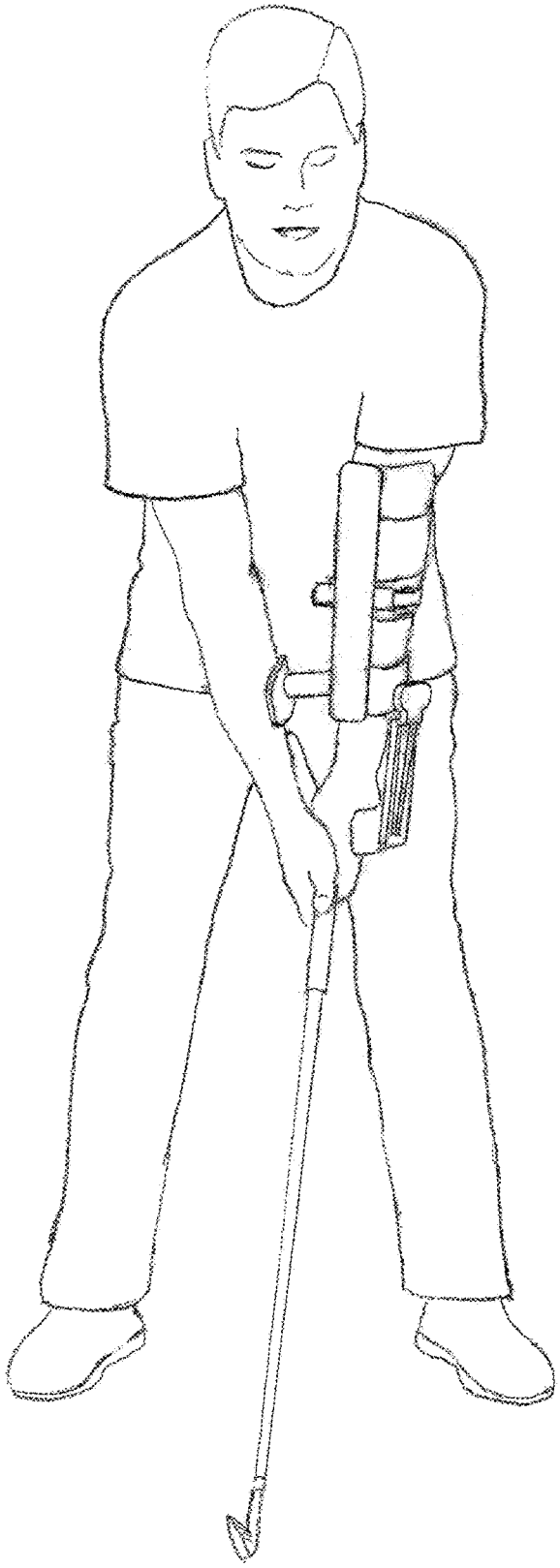
FIG. 3 is a perspective view of a right-handed golfer wearing the apparatus of the invention.

Referring now to the figures, and in accordance with the present invention there is provided a novel and improved training apparatus to be worn on the arm of a golfer, the apparatus comprising an elongate substantially rigid support emember or main beam 1, carrying three individual arm braces designated 2, 3 and 4. One brace 2 extends from a proximal end of the support member, and another indicated at 4, extends from the distal end thereof. Both braces have generally open mouths to receive and clasp spaced apart portions of the golfer's arm when the apparatus is in place. The apparatus is adjustable on the golfer's target facing arm as in FIG. 3.

Further by the invention, the center brace 3 has an adjustable strap 6 extending across its mouth, which can form a continuous loop around the wearer's arm. There is also provided a ratchet mechanism or buckle 5 which conveniently is adjustable by the player's free hand. The strap 6 attaches to one side of the arm brace 3, and is fed through guides in an elbow cup 7 and back through the buckle 5.

The strap 6 is used to bring the golfers target side elbow gently towards hyper-extension to keep the leading arm comfortably straight.

Figure 1:
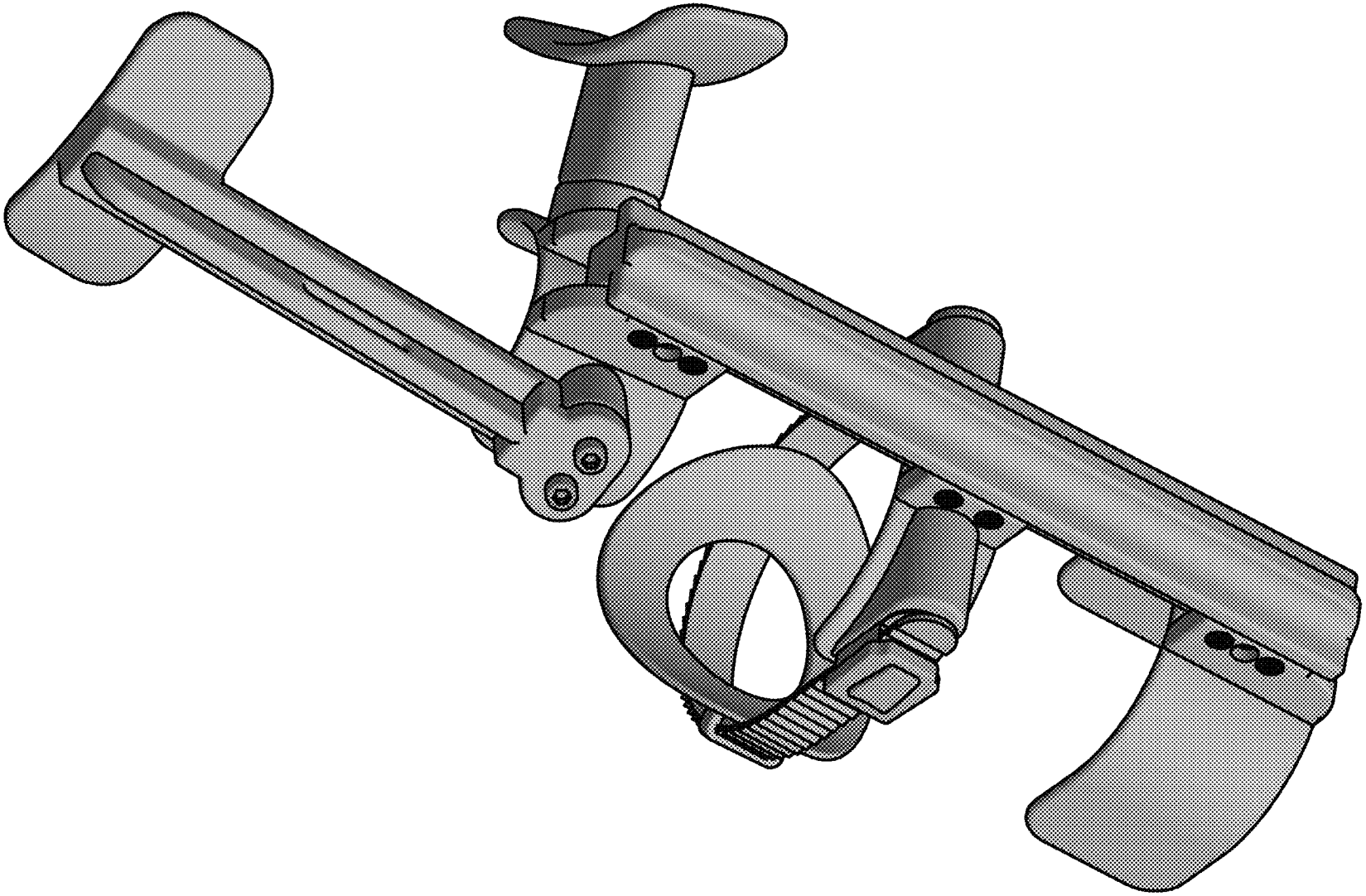
FIG. 1 is a perspective view of the apparatus of the present invention.
Figure 2:
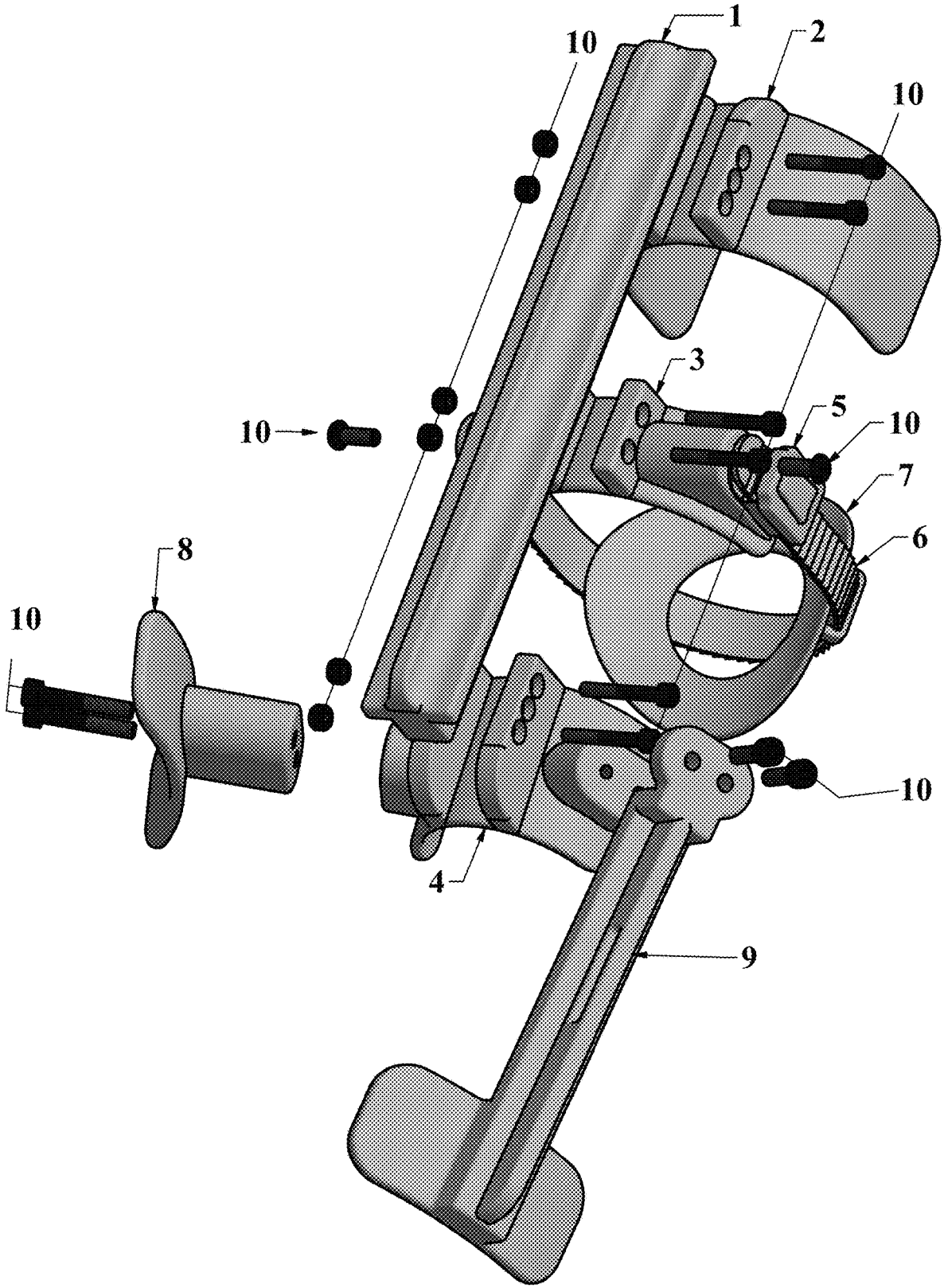
FIG. 2 is an exploded view of the apparatus.

Braces 2 and 4 in FIG. 2 can be bolted onto the main beam in multiple positions and can be made in different sizes to accommodate different golfers.

Moreover, a trail forearm brace shown as 8 in FIG. 2 can be attached to the lower brace 4. The trail forearm is held against the trail forearm brace 8, keeping the trail arm in the "tucked" position, with elbow against the side of the golfer.

The invention has the following additional advantages. First, it recognizes the frustration of the average golfer in trying to keep a proper golf frame, keeping a straight lead arm past impact, a tucked left elbow and a body driven swing, for a It is further noted that the apparatus of the invention also has a rear arm stirrup to enforce the feeling of a tucked rear arm as noted above, and reinforces the desired triangle that good golfers achieve with their arms throughout the swing. There is a removable front brace that can be added for chipping and pitching.

A wrist guide support 9, FIG. 2, can be attached to the lower brace of the lead arm. This keeps the golfers left wrist flat to promote a body rotation rather than a "flip" of the wrists. This is only used for chipping, and short chip shots to ingrain the proper motion for these short shots. The components can be injection molded plastics made with various shore ratings. The strap 6 and various bolts 10 along with foam padding are commercially available.

The device as thus described and illustrated is believed to constitute a distinct advance and improvement in the golf accessory arts.

Variations and modifications are possible without departing from the spirit of the invention.

The embodiments of the invention in which an exclusive property or privilege is claimed are defined as follows:

1. A training apparatus for golf, to be worn on an arm of a player, said apparatus comprising:

an elongate, substantially rigid support member having two oppositely disposed end portions, three arm braces affixed to the elongate support member, including a first arm brace being attached to one end portion of the support member, a second arm brace being attached to the opposite end portion of the support member, and a third arm brace being attached in between the end portions of the support member, said third arm brace having an open mouth spanned by a strap to provide a continuous loop that surrounds an arm of a player, an adjustable tensioning device connected with the third arm brace and the strap, for enabling a player to adjust the force from the strap, to an arm, so as to permit a player to tighten the strap when installing the training apparatus, or to loosen the strap when removing the training apparatus; and a trail forearm brace, configured to be held against a second arm of a player, wherein the trail forearm brace is attached to the first arm brace.

2. The training apparatus according to claim 1, wherein:

said adjustable tensioning device comprises a ratchet mechanism for effecting said tightening or loosening of the device on a player's arm.

3. The training apparatus according to claim 1, wherein the trail forearm brace comprises a shaft attached to the first arm brace at one end of the shaft, and a forearm support member attached to the shaft at the opposite end of the shaft.

4. The training apparatus according to claim 3, wherein the forearm support member is curved.

5. The training apparatus according to claim 3, wherein the trail forearm brace is attached to the first arm brace by one or more bolts extending through the shaft.

6. The training apparatus according to claim 1, further comprising a wrist guide support attached to the first arm brace.

7. The training apparatus according to claim 6, wherein the wrist guide support comprises a shaft attached to the first arm brace at one end and a wrist support member arranged at the opposite end of the shaft.

8. The training apparatus according to claim 6, wherein the wrist guide support comprises a shaft attached to the first arm brace at one end and a wrist support member arranged at the opposite end of the wrist guide support shaft.

9. A training apparatus for golf, to be worn on an arm of a player, said apparatus comprising:

an elongate, substantially rigid support member having two oppositely disposed end portions, three arm braces affixed to the elongate support member, including a first arm brace being attached to one end portion of the support member, a second arm brace being attached to the opposite end portion of the support member, and a third arm brace being attached in between the end portions of the support member, said third arm brace having an open mouth spanned by a strap to provide a continuous loop that surrounds an arm of a player, an adjustable tensioning device connected with the third arm brace and the strap, for enabling a player to adjust the force from the strap, to an arm, so as to permit a player to tighten the strap when installing the training apparatus, or to loosen the strap when removing the training apparatus; and a trail forearm brace, configured to be held against a second arm of a player, wherein each of the three arm braces is attached to the support member by one or more bolts.

10. The training apparatus according to claim 9, wherein:

said adjustable tensioning device comprises a ratchet mechanism for effecting said tightening or loosening of the device on a player's arm.

11. The training apparatus according to claim 9, further comprising a wrist guide support attached to the first arm brace.

12. The training apparatus according to claim 9, wherein the trail forearm brace comprises a shaft attached to the first arm brace at one end of the shaft, and a forearm support member attached to the shaft at the opposite end of the shaft.

13. The training apparatus according to claim 12, wherein the forearm support member is curved.

14. A training apparatus for golf, to be worn on an arm of a player, said apparatus comprising:

an elongate, substantially rigid support member having two oppositely disposed end portions, three arm braces affixed to the elongate support member, including a first arm brace being attached to one end portion of the support member, a second arm brace being attached to the opposite end portion of the support member, and a third arm brace being attached in between the end portions of the support member, said third arm brace having an open mouth spanned by a strap to provide a continuous loop that surrounds an arm of a player, an adjustable tensioning device connected with the third arm brace and the strap, for enabling a player to adjust the force from the strap, to an arm, so as to permit a player to tighten the strap when installing the training apparatus, or to loosen the strap when removing the training apparatus; and a trail forearm brace, configured to be held against a second arm of a player, wherein the third arm brace comprises an elbow cup.

15. The training apparatus according to claim 14, wherein:

said adjustable tensioning device comprises a ratchet mechanism for effecting said tightening or loosening of the device on a player's arm.

16. The training apparatus according to claim 14, further comprising a wrist guide support attached to the first arm brace.

17. The training apparatus according to claim 14, wherein the trail forearm brace comprises a shaft attached to the first arm brace at one end of the shaft, and a forearm support member attached to the shaft at the opposite end of the shaft.

18. The training apparatus according to claim 17, wherein the forearm support member is curved.

* * * * *